US007938204B2

(12) United States Patent
Buske

(10) Patent No.: US 7,938,204 B2
(45) Date of Patent: May 10, 2011

(54) REAMER WITH IMPROVED HYDRAULICS FOR USE IN A WELLBORE

(75) Inventor: Robert J. Buske, The Woodlands, TX (US)

(73) Assignee: Baker Hughes Incorporated, Houston, TX (US)

( * ) Notice: Subject to any disclaimer, the term of this patent is extended or adjusted under 35 U.S.C. 154(b) by 97 days.

(21) Appl. No.: 12/239,239

(22) Filed: Sep. 26, 2008

(65) Prior Publication Data

US 2009/0159338 A1 Jun. 25, 2009

Related U.S. Application Data

(60) Provisional application No. 61/016,222, filed on Dec. 21, 2007.

(51) Int. Cl.
*E21B 10/18* (2006.01)
*E21B 10/26* (2006.01)
*E21B 10/60* (2006.01)

(52) U.S. Cl. ..... 175/340; 175/344; 175/393; 175/406

(58) Field of Classification Search ..... 175/344, 175/340, 406, 393
See application file for complete search history.

(56) References Cited

U.S. PATENT DOCUMENTS 2,103,583 A * 12/1937 Howard et al. ..... 175/344
2,746,719 A * 5/1956 Seligman ..... 175/53
3,016,099 A * 1/1962 Woodruff ..... 175/344
3,917,011 A * 11/1975 Hester ..... 175/339
4,071,098 A 1/1978 Dively et al.
4,106,577 A * 8/1978 Summers ..... 175/340
4,516,642 A * 5/1985 Childers et al. ..... 175/340
4,989,680 A * 2/1991 Deane et al. ..... 175/340
5,052,503 A 10/1991 Lof
5,560,440 A 10/1996 Tibbitts
5,992,542 A * 11/1999 Rives ..... 175/53
6,386,298 B1 5/2002 Smith et al.
6,568,492 B2 5/2003 Thigpen et al.
6,609,580 B2 8/2003 Beaton
6,729,418 B2 5/2004 Slaughter, Jr. et al.
6,827,161 B2 12/2004 Singh et al.
6,902,014 B1 6/2005 Estes
6,959,774 B2 11/2005 Nackerud
7,066,288 B2 6/2006 Van Klompenburg et al.
7,137,460 B2 11/2006 Slaughter, Jr. et al.
(Continued)

FOREIGN PATENT DOCUMENTS

JP 04-062291 A 2/1992
(Continued)

OTHER PUBLICATIONS

International Search Report Dated Jul. 31, 2009, for Related Application PCT/US2008/087972.

*Primary Examiner* — Jennifer H Gay
(74) *Attorney, Agent, or Firm* — Bracewell & Giuliani LLP

(57) ABSTRACT

A reamer bit for use in earth boring operations comprising a body, mounting elements on the bit body having rolling cutters, and nozzles configured to emit a cleaning spray that is angled with respect to the well bottom. The cleaning spray may be angled up to about 20° with respect to the well bottom. The reamer may further include a pilot bit on a drill pipe extending downward from the reamer body.

18 Claims, 4 Drawing Sheets

U.S. PATENT DOCUMENTS

| | | | | |
|---|---|---|---|---|
| 7,152,702 | B1 | 12/2006 | Bhome et al. | |
| 7,213,661 | B2 * | 5/2007 | Larsen et al. | 175/340 |
| 2002/0020565 | A1 | 2/2002 | Hart et al. | |
| 2004/0074672 | A1 | 4/2004 | Rives | |
| 2005/0252693 | A1 | 11/2005 | Brannstrom | |
| 2006/0096788 | A1 | 5/2006 | Virtanen | |
| 2007/0175664 | A1 | 8/2007 | Holmgren | |
| 2009/0090561 | A1 * | 4/2009 | Patel | 175/340 |
| 2009/0159338 | A1 * | 6/2009 | Buske | 175/57 |
| 2009/0218140 | A1 * | 9/2009 | Pessier et al. | 175/57 |

FOREIGN PATENT DOCUMENTS

| | | | |
|---|---|---|---|
| JP | 2002-250193 | A | 9/2002 |
| WO | WO 97-34071 | A1 | 9/1997 |

* cited by examiner

REAMER WITH IMPROVED HYDRAULICS FOR USE IN A WELLBORE

RELATED APPLICATIONS

This application claims priority to and the benefit of U.S. Provisional Application Ser. No. 61/016,222, filed Dec. 21, 2007, the full disclosure of which is hereby incorporated by reference herein.

BACKGROUND

1. Field of Invention

This disclosure relates to earth boring reamer bits, and particularly to reamer bits configured to discharge fluids at a low impingement angle to the reamer bit cutting surface.

2. Description of Prior Art

Drill bits used in drilling of subterranean well bores typically comprise drag bits and roller cone bits. Roller cone bits typically comprise a body having legs extending downward and a head bearing extending from the leg towards the axis of the bit body. Frusto-conically shaped roller cones are rotatably mounted on each of these journals and have inserts on the outer surface of these cones. As the bit rotates, the cones rotate to cause the cutting elements to disintegrate the earth formation.

In some situations a pilot reamer drilling system is employed where two or more bits are combined on a single drill string at different vertical positions. The lower bit of the pilot reamer drilling system, which is commonly referred to as a pilot bit, creates a pilot hole. The upper bit, which follows the lower bit in the drilling process, enlarges the hole diameter over that created by the pilot bit. The bit enlarging the hole diameter is referred to as a reamer bit. Typically the pilot bit comprises a conventional earth boring bit, i.e. either a roller cone bit or a drag bit. The reamer bit usually employs rolling cutters as cutting members modified for attachment to the reamer bit body. Pilot reamer drilling systems are used to drill large diameter boreholes that require enhanced stabilization.

Drilling fluid for dispersing drilled up material and cooling the cutting elements may be injected at the cutting surfaces through nozzles. The injected fluid forms jet streams that typically are conically shaped and directed downward from the bit body. The fluid is typically injected as a high velocity jet to clean debris from drill bit cutting element thereby enhancing drilling. The dislodged particles are carried up through the borehole annulus to the surface for disposal.

SUMMARY OF INVENTION

The disclosure herein includes a reamer bit for downhole earth boring operations comprising a reamer body having an axis, mounting elements depending from the body, cutters rotatingly mounted on each mounting element, and a nozzle configured to form a fluid spray at an angle away from the body axis. The cutter includes cutting elements configured to cuttingly engage a wellbore bottom surface. In one embodiment, the fluid spray is directed to the cutting surface in advance of the cutting elements. The fluid spray may impinge the cutting surface in a substantially shallow angle of from about 3° up to about 20° with respect to the cutting surface. The reamer bit can further comprise a drill shaft extending from the body lower end and a pilot bit affixed to the drill shaft terminal end. The pilot bit may be a roller cone bit or a drag bit. The reamer bit is rotatable and the nozzle is configurable to direct a fluid spray in the direction of the reamer bit rotation.

BRIEF DESCRIPTION OF DRAWINGS

Some of the features and benefits of the present invention having been stated, others will become apparent as the description proceeds when taken in conjunction with the accompanying drawings, in which.

Figure 1:
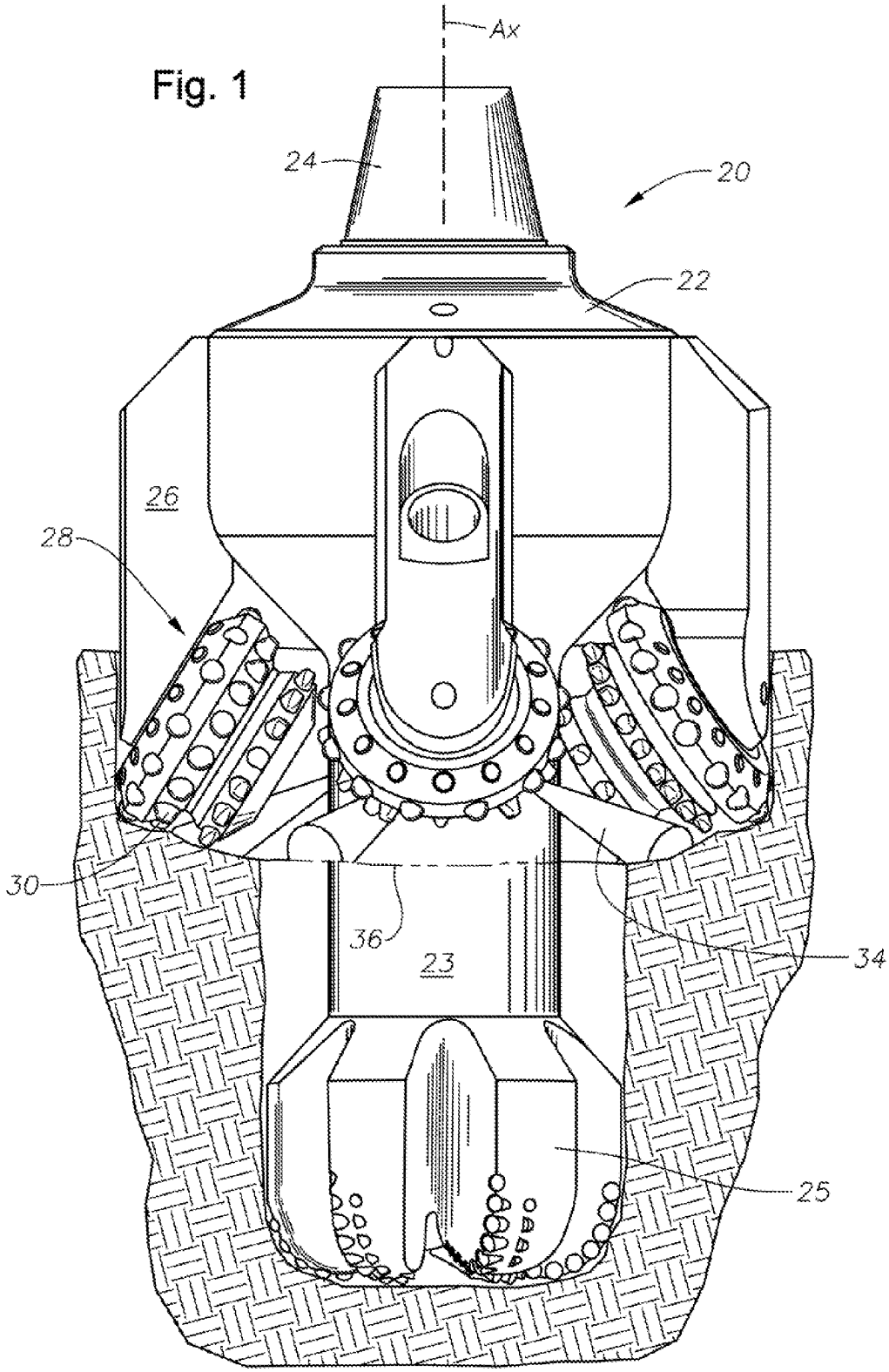
FIG. 1 is a side view of a reamer bit body with roller cone bits and hydraulic spray exiting the body.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

The present invention will now be described more fully hereinafter with reference to the accompanying drawings in which embodiments of the invention are shown. This invention may, however, be embodied in many different forms and should not be construed as limited to the illustrated embodiments set forth herein; rather, these embodiments are provided so that this disclosure will be thorough and complete, and will fully convey the scope of the invention to those skilled in the art. Like numbers refer to like elements throughout.

It is to be understood that the invention is not limited to the exact details of construction, operation, exact materials, or embodiments shown and described, as modifications and equivalents will be apparent to one skilled in the art. In the drawings and specification, there have been disclosed illustrative embodiments of the invention and, although specific terms are employed, they are used in a generic and descriptive sense only and not for the purpose of limitation. Accordingly, the invention is therefore to be limited only by the scope of the appended claims.

FIG. 1 provides in a side view an example of a reamer 20 comprising a generally cylindrical body 22 having mounting elements for attaching rolling cutters to the body 22. In FIG. 1, the mounting elements are bit legs 26 affixed to the body 22 outer lateral periphery. The bit legs 26, which may be welded into pockets formed on the outer surface of the bit body 22 extend downward and generally parallel with the body axis A. Each bit leg 26 comprises a shaft (not shown) extending from the bit body 26 and angled in a generally downward direction in towards the axis A. In the embodiment of FIG. 1, the rolling cutters comprise cones 28 that are rotatably mounted on each shaft and have rows of inserts 30 formed in a generally circumferential arrangement on the cone 28 outer surface. The inserts 30 also referred to as cutting elements or teeth may be integrally formed, such as by machining, or later attached after forming the cone 28 and affixed by an interference fit, welding, and/or brazing. For use in earth boring operations, a connector 24 is provided on the upper portion of the housing 22 having threads (not shown) formed for coupling with an associated drill string. As is known, the drill string provides both downward force and rotatable force for drilling action within an associated formation.

Optionally, a shaft 23 may be included with the reamer 20 for connection to a pilot bit 25. Associated pilot bits with a reamer may be used for situation where an enhanced diameter well bore is desired or to increase the stability of the drilling operations. The reamer bit 20 is further equipped with nozzles 32 configured to emit a fluid spray 34 in a direction away from the body axis $A_x$ and towards the cutting surface 36 engagable by the cones 28. By being directed "away" from the body axis $A_x$ the fluid spray 34 effectively sweeps across the cutting surface 36. In contrast, a fluid spray directed largely downward impinges perpendicular the borehole bottom cutting surface covering a smaller area. Additionally, fluid spray 34 embodiments include a jet, where the jet can possess sufficient energy to remove formation in addition to circulating material excavated by the bit 20.

Figure 2:
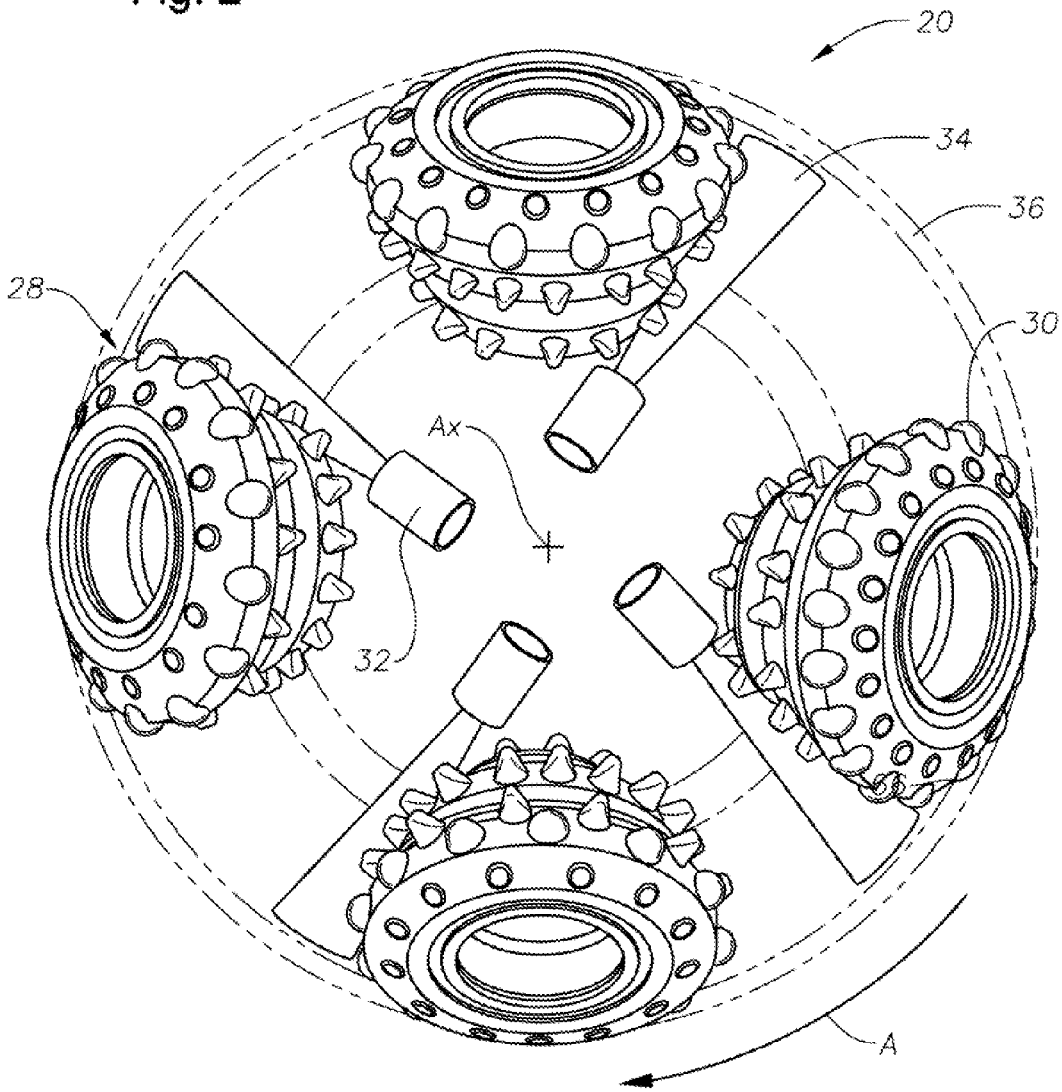
FIG. 2 is an overhead view of roller cone and nozzle portions of a reamer bit illustrating fluid spray pattern exiting the nozzles.

FIG. 2 illustrates selected components of the reamer bit 20. Shown in FIG. 2 are the cones 28 and their path of cutting a well bore bottom over the associated cutting surface 36. Nozzles 32, shown radially inward from the cones 28, are configured to direct a fluid spray 34 onto the cutting surface 36 in advance of the cones 28. For the purposes of this disclosure, "in advance" refers generally to the expected path the cones 28 traverse on the cutting surface 36 while the cones are being rotated. The "in advance" region includes the cutting surface adjacent a cone 28 that upon any cone rotation will engage that surface; this region extends along the cutting surface 36 up to where the next adjacent cone 28 is contacting the cutting surface 36. Arrow A illustrates the rotational direction of the reamer bit 20 within the borehole and along the cutting surface 36. Thus as shown in FIG. 2, the sprays 34 contact the in advance region proximate to their associated cones 28. Accordingly, in this embodiment directing the fluid spray 34 on the cutting surface 36 in advance of the cones provides a cleaning effect by removing any cuttings or other debris away from the projected path of an associated cutting cone 28. The scope of this disclosure is not limited to bits having cleaning fluid nozzles directed in the in advance region, but also includes reamers having nozzles configured to direct a fluid spray in any radial direction, including at an associated cone 28.

Directing the fluid spray 34 at a shallow angle with respect to the cutting surface, the fluid spray 34 cleans the entire width (or radius) of the cutting surface 36. For the purposes of discussion herein, a shallow angle includes angles of from about 3° up to about 20° with respect to the cutting surface. The fluid spray may be directed at any angle between about 3° and about 20° specifically including from about 5° up to about 15°, from about 5° up to about 10°, as well as from about 5° up to about 7°. Removing the cuttings from the cutting surface 36 enables the cones 28 with its respective elements 30 to fully engage the cutting surface 36 without interference from previous cuttings or other debris. This reduces the chances for the cuttings to be redrilled by an adjacent cutter cone 28. Fluid discharged from the nozzles 32 may be redirected up the annulus between the drill string and wellbore for recycling and removing the cuttings and other debris.

Figure 3:
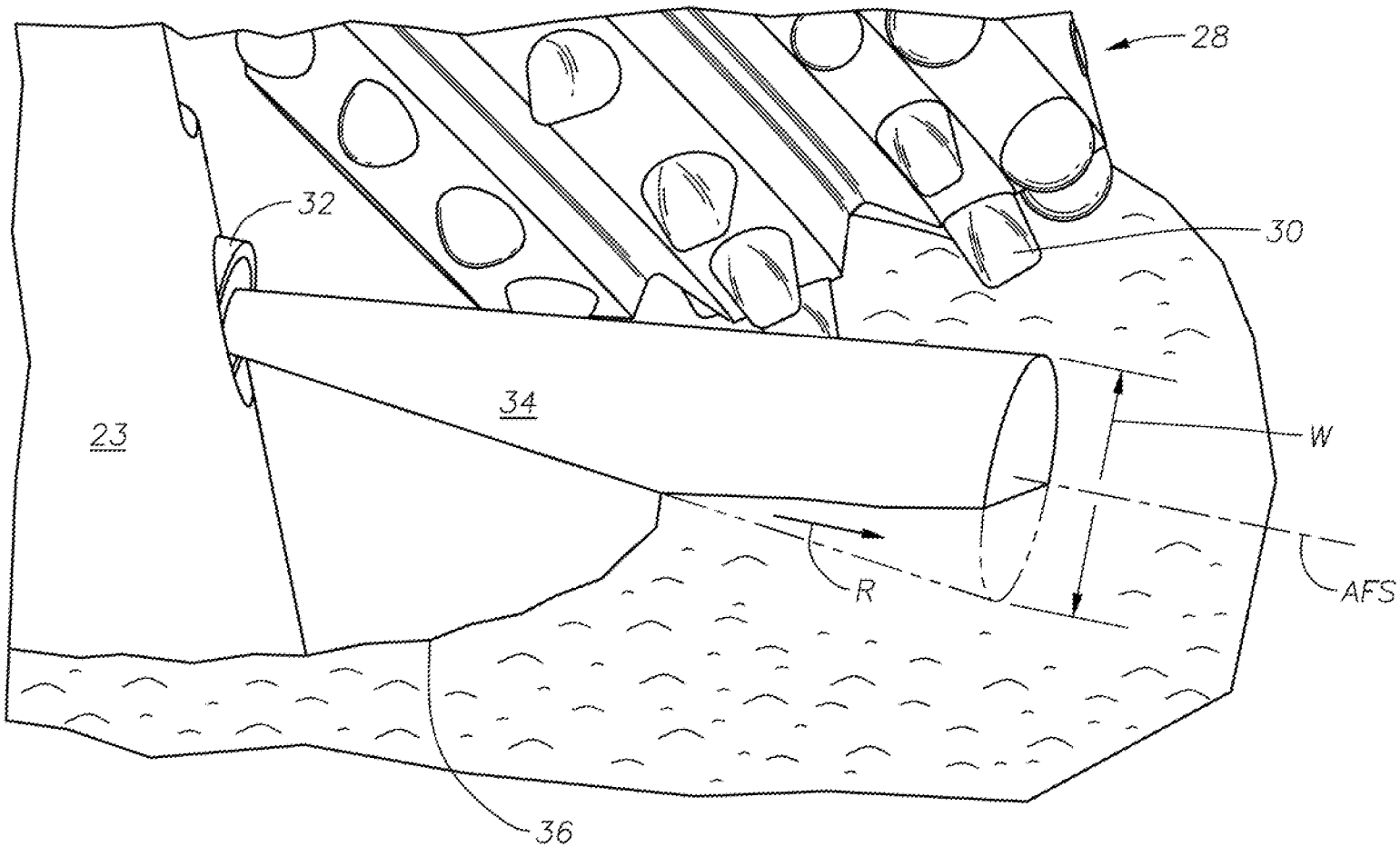
FIG. 3 is a side perspective view of a fluid spray exiting a reamer bit body.

A side view of a fluid spray 34 interacting with the cutting surface 36 shown in a perspective view in FIG. 3. In this embodiment the nozzle 32 is shown secured within a portion of the shaft and vertically above the cutting surface 36. Thus the resulting fluid spray 34 has a shallow downward angle, its center impinges close to the radius R middle. As can be seen, the fluid spray 34 contacts the cutting surface 36 along most of the radius R of the cutting surface 36. The fluid spray axis $A_{FS}$ may range at an angle with respect to the housing axis A from about 60° to about 90° and all angular values therebetween. The fluid spray 34 is not limited to the shape illustrated, but may have a wider or more narrow fan width W.

Figure 4:
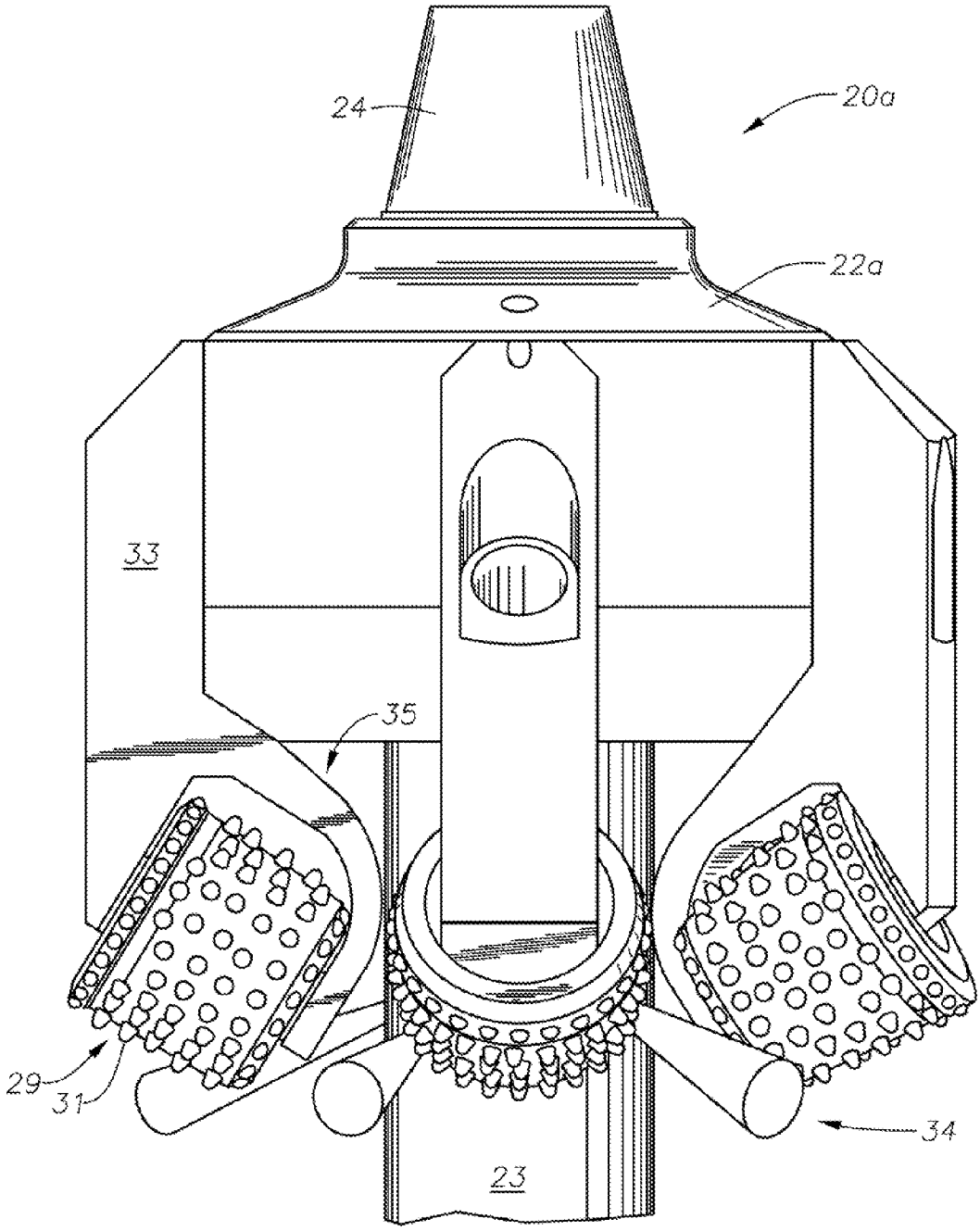
FIG. 4 depicts in a side view a reamer bit body with rolling cutters and hydraulic spray exiting the body.

An alternative embodiment of a reamer bit 20*a* is illustrated in side view in FIG. 4. The rolling cutters provided on the reamer bit 20*a* in FIG. 4 are cylindrical cutters 29. The mounting elements for attaching the rolling cutters to the reamer bit 20*a* comprise cradle mounts 33. The cylindrical cutters 29 have impacts 31 formed on their outer circumference and rotate on a shaft (not shown) that extends through the cylindrical cutter 29 axis. The shaft ends are mounted in a cradle arm 35 that extends parallel to the shaft and over the cutter 29. The cradle arm 35 depends at an angle downward from the cradle mount 33 lower end The cradle mount's 33 structure for attachment to the bit body 22*a* is similar to the bit leg 26 structure for attachment to the bit body 22 of FIG. 1. Fluid sprays 34 are shown directed outward past the cutters 29 from the shaft 23.

The invention claimed is:

1. A reamer bit for downhole earth boring operations in a borehole comprising:

a reamer body having a body axis;

mounting elements depending from the body and symmetrically arranged around the body axis;

a rolling cutter rotatably mounted to each of the mounting elements, so that when the reamer body is rotated about the axis in the borehole, the rolling cutters follow an arcuate path in the borehole; and a plurality of nozzles, each configured to form a fluid spray directed along a fluid spray axis that is disposed away from the body axis and intersects the arcuate path; and wherein each fluid spray axis intersects a plane perpendicular to the body axis at an angle between 3 degrees and 20 degrees.

2. The reamer bit according to claim 1, wherein each of the rolling cutters includes cutting elements configured to cuttingly engage a wellbore cutting surface, and wherein the fluid spray of each of the nozzles is directed to impinge fluid spray on the cutting elements along a leading side of one of the cutters.

3. The reamer bit according to claim 1, wherein the fluid spray axis of each of the nozzles passes closer to a leading side of one of the cutters than a trailing side of an adjacent one of the cutters.

4. The reamer bit according to claim 1, further comprising:

a drill shaft extending from the body lower end and having a terminal end for affixing a pilot bit; and wherein each of the nozzles is mounted to the drill shaft at a point below a lower end of each of the mounting elements.

5. The reamer bit according to claim 1, wherein the fluid spray axis of each of the nozzles does not intersect the body axis.

6. The reamer bit according to claim 1 wherein each flowline axis is oriented such that a radial plane emanating from the body axis and passing through an outlet of each of the nozzles is at an angle relative to the flowline axis of each of the nozzles.

7. The reamer bit according to claim 1, wherein each fluid spray axis intersects a plane perpendicular to the body axis at an angle between 5 degrees and 15 degrees.

8. The reamer bit according to claim 1, wherein each fluid spray axis intersects a plane perpendicular to the body axis at an angle between 5 degrees and 10 degrees.

9. A pilot reamer apparatus for earth boring use comprising:

a reamer body having an upper end and a lower end, and a body axis extending through the upper and lower ends;

a plurality of mounting elements on the body outer periphery depending downwardly and symmetrically arranged around the body axis;

a rolling cutter rotatingly affixed to each of the mounting elements for cutting engagement with a wellbore bottom cutting surface;

a drill shaft extending from the body lower end and having a terminal end for affixing a pilot bit;

a plurality of nozzles mounted symmetrically around the drill shaft, each having a fluid spray axis configured to pass between two of the cutters and closer to a leading side of one of the cutters than to a trailing side of an adjacent one of the cutters; and wherein each fluid spray axis intersects a plane perpendicular to the body axis at an angle between 3 degrees and 20 degrees and is oriented to cause fluid spray to contact the wellbore bottom cutting surface.

10. The pilot reamer apparatus of claim 9 wherein each of the nozzles is mounted to the drill shaft at a point below a lower end of each of the mounting elements.

11. The pilot reamer apparatus of claim 9 wherein each flowline axis is oriented such that a radial plane emanating from the body axis and passing through an outlet of each of the nozzles is at an angle relative to the flowline axis of each of the nozzles.

12. The pilot reamer apparatus according to claim 9, wherein each fluid spray axis intersects a plane perpendicular to the body axis at an angle between 5 degrees and 15 degrees.

13. The pilot reamer apparatus according to claim 9, wherein each fluid spray axis intersects a plane perpendicular to the body axis at an angle between 5 degrees and 10 degrees.

14. A method of forming a wellbore comprising:

conducting earth boring operations with a reamer bit, wherein the reamer bit comprises a body having a body axis, mounting elements depending from the body, rolling cutters rotatingly affixed to the mounting elements and having cutting elements formed in rows on an outer surface of the rolling cutters, and nozzles configured to direct a fluid spray on a cutting surface in advance of the rolling cutters, each of the nozzles being oriented with a fluid spray axis at an angle of from about 3 degrees to about 20 degrees relative to a plane perpendicular to the body axis;

rotating the reamer bit to cause the rolling cutters to cut a wellbore cutting surface; and discharging a cleaning fluid spray from the nozzles against the cutting surface thereby removing cuttings from the cutting surface in advance of the rolling cutters.

15. The method of claim 14, wherein the method further comprises directing the fluid spray from each of the nozzles closer to a leading side of one of the cutters than a trailing side of an adjacent one of the cutters.

16. The method of claim 14 wherein the reamer bit is engaged in earth boring operations in combination with a pilot bit.

17. The method of claim 14 wherein each fluid spray axis intersects a plane perpendicular to the body axis at an angle between 5 degrees and 15 degrees.

18. The method of claim 14, wherein each fluid spray axis intersects a plane perpendicular to the body axis at an angle between 5 degrees and 10 degrees.

* * * * *

UNITED STATES PATENT AND TRADEMARK OFFICE

CERTIFICATE OF CORRECTION

PATENT NO. : 7,938,204 B2
APPLICATION NO. : 12/239239
DATED : May 10, 2011
INVENTOR(S) : Robert J. Buske It is certified that error appears in the above-identified patent and that said Letters Patent is hereby corrected as shown below:

Column 4, line 8, delete “impacts” and insert --compacts--

Signed and Sealed this
Sixth Day of September, 2011

David J. Kappos

David J. Kappos
*Director of the United States Patent and Trademark Office*